US005478087A

United States Patent [19]

Dumisani

[11] Patent Number: 5,478,087

[45] Date of Patent: Dec. 26, 1995

[54] MATHEMATICAL BOARD GAME AND METHOD OF PLAYING THE SAME

[76] Inventor: Dwaine Dumisani, 4203 10th St., NE., Washington, D.C. 20017

[21] Appl. No.: 409,678

[22] Filed: Mar. 23, 1995

[51] Int. Cl.[6] ..... A63F 3/00

[52] U.S. Cl. ..... 273/272; 273/299

[58] Field of Search ..... 273/236, 272, 273/264, 271; 434/188, 191, 200, 208, 209, 128

[56] References Cited

U.S. PATENT DOCUMENTS

| | | |
|---|---|---|
| 2,320,832 | 5/1943 | Schoenberg et al. . |
| 3,224,114 | 12/1965 | Swanson . |
| 3,267,590 | 8/1966 | Browning . |
| 3,460,835 | 8/1969 | Crans . |
| 3,545,101 | 12/1970 | Fike . |
| 3,659,851 | 5/1972 | Lang et al. . |
| 3,844,568 | 10/1974 | Armstrong . |
| 3,984,108 | 10/1976 | Marzo . |
| 4,017,080 | 4/1977 | Severson . |
| 4,565,374 | 1/1986 | Pak . |
| 5,120,226 | 6/1992 | Tsai . |
| 5,139,271 | 8/1992 | Bez . |
| 5,176,381 | 1/1993 | Winters . |
| 5,314,190 | 5/1994 | Lyons . |

OTHER PUBLICATIONS

From Harriet Griffin's Text *Elementary Theory of Numbers*, pp. 193–194.

*Primary Examiner*—William M. Pierce

*Attorney, Agent, or Firm*—Sixbey, Friedman, Leedom & Ferguson

[57] ABSTRACT

A mathematical board game including a game board bearing a rectangular grid defining a plurality of ranks and files. Additionally, the game board includes a scoring apparatus composed of two groups of labeled scoring bins, one group for each playing team, for the purpose of recording the score as the game is played. The game board also includes a sum/point tabulation table which provides a cross reference, relating sums with scoring points awarded for each sum. A plurality of scoring 'stones' are provided for each player. Upon scoring, the scoring player places a single stone in his labeled scoring bin corresponding to the number of points scored. A plurality of tiles are also provided for each player, each tile being marked with a symbol representing one of the numbers in the range [1, 2, 3, . . . , N×M] for placing on the board, where N is the number of ranks and M is the number of files. The players alternately select one tile at a time and place it at any playing position on the rectangular grid in an attempt to provide rank, file, or diagonally contiguous combinations which provide a particular type of sum. The desired sums may be only odd number sums, or the desired sums may be only even sums. Alternatively, the desired objective for one player may be even number sums and for the other player odd number sums.

11 Claims, 1 Drawing Sheet

MATHEMATICAL BOARD GAME AND METHOD OF PLAYING THE SAME

TECHNICAL FIELD

The present invention relates to a board game and in particular, discloses a mathematical game wherein the scoring is provided by a particular player successfully placing a plurality of tile pieces bearing numerical indicia on contiguous playing positions so that the sum of the numerical indicia belongs to a predefined class of numbers.

BACKGROUND OF THE INVENTION

Challenging board games which require mathematical skill have been popular in the United States and other countries for many years. It is generally the purpose of these games to provide a challenge to the player which will test mathematical and reasoning skills wherein blocking and sequencing plays are used. A number of mathematical board games which provide limited testing of mathematical skills, reasoning skills and which have educational, as well as entertainment value, have been known in the past.

For example, U.S. Pat. No. 4,565,374 to Pak discloses a mathematical game wherein contiguous sequences of numbered tiles are formed by blindly drawing tiles from a bag, shielding them from the opponent, and placing these tiles—distinguishable from the opponent's tiles by color—on the playing surface to form a sum which is a multiple of 10. Duplicate numerals are allowed on the board which make tracing, and thus, strategizing difficult. The purpose of this game is to outscore the opponent by forming defined sequences of numbered tiles whose sum is greater than a predetermined number. No points, however, may be scored by virtue of a sequence consisting of tiles of two different players.

U.S. Pat. No. 3,460,835 to Crans shows a game of similar construction where ranks and files are used to form sequences of numbered tiles which have again been blindly drawn from a bag. The tiles are shielded from the opponent, and one player scores along ranks only, while the other is allowed to score along files only. The purpose of this game is to form sequences of tiles which sum as close as possible to a single, predetermined number (175 in the preferred embodiment of the game).

U.S. Pat. No. 5,120,226 to Tsai shows a simple mathematical teaching aid which essentially is an array of ranks and files which accept numbered cubes used to form products of positive integers. An integral part of this teaching aid is a multiplication table which slides under the ranks and files for checking the accuracy of the multiplication.

U.S. Pat. No. 3,545,101 to Fike shows a mathematical game composed of ranks and files of integers in random order. This game requires an instructor, and can be played by several players, each with his own game board. The instructor calls out an arithmetic problem and each student marks what he believes to be the correct answer on his board. The first student to correctly mark one full row or one full column is the winner of the game.

U.S. Pat. No. 3,659,851 to Lang discloses an elementary mathematics/tic-tac-toe game involving a rectangular array of ranks and files.

While the prior art board games provide entertainment, education and support the application of play-by-play, limited tactics, the prior art fails to disclose a pure game of skill (as opposed to chance) which supports attacking and enticing the opponent with board plays without the limitation of luck-of-the draw and guessing which tiles your opponent has. The prior art also fails to disclose a board game which encourages player positioning (strategy) before employing scoring methods (tactics). The prior art also fails to disclose a game board which contains a scoring apparatus integral with the playing surface of the game board to eliminate the need for pencil and paper. Consequently, there is a need for a board game which provides a sufficient number of playing combinations, not easily memorized, which result in scoring points. Moreover, there is a need for a board game which provides for an easy reconstruction of the sequence and placement of tile moves by simple examination of the positions of the game tiles.

SUMMARY OF THE PRESENT INVENTION

It is an object of the present invention to overcome the deficiencies of the prior art and provide a novel and entertaining mathematical board game requiring strategy and skill, rather than chance.

It is another object of the present invention to provide a mathematical board game which enhances the ability to add numbers and compare these sums to other possible board sums in order to calculate an optimum play before it is played.

It is yet another object of the present invention to teach the concept of ordinal numbers by selecting numbered tiles in numerical order and placing these numbered tiles on the game board.

It is a further object of the present invention to provide a method of playing a mathematical board game wherein players are each provided with a predetermined number of tile pieces, each bearing a symbol representing a positive integer wherein the players alternately place one tile at a time on the grid of a game board in an attempt to form a sum of numbers from rank, file, or diagonally contiguous tiles, this sum being a member of a predefined class of numbers.

It is still a further object of the present invention to provide a method of playing a board game wherein the reconstruction of the game, at any given time, is provided by simple examination of the tile positions on the board.

It is another object of the present invention to provide a method of playing a board game which has an abundance of combinations of numbers which sum to an odd number, requiring the addition of these numbers, not the mere memorization of a few sequences of numbers.

It is still another object of the present invention to provide a mathematical board game including a scoring apparatus integral with the game board.

The present invention provides a unique mathematical board game apparatus and method of playing, including a game board with a rectangular grid, a plurality of tile pieces having indicia inscribed thereon, two groups of scoring bins integral with the game board, a sum/point reference table and a plurality of scoring stones to be placed inside one or more of the twelve scoring bins to indicate a score. The plurality of tile pieces are divided among the players, preferably two, such that one player receives the odd numbered tiles and the other player receives the even numbered tiles. The tiles are then alternately placed on the game board by each player. Points are scored by completing an odd sum in one or more of a rank, file, or diagonal of the game board. The rules of the game are such that it is to each player's advantage to first play for optimum positioning of his tiles before moving to score directly, or by enticing the opponent into a trap, or playing to block the opponent's scoring threat.

These and other objects of the present invention will become apparent from the detailed description below.

DETAILED DESCRIPTION OF THE PRESENT INVENTION

Figure 1:
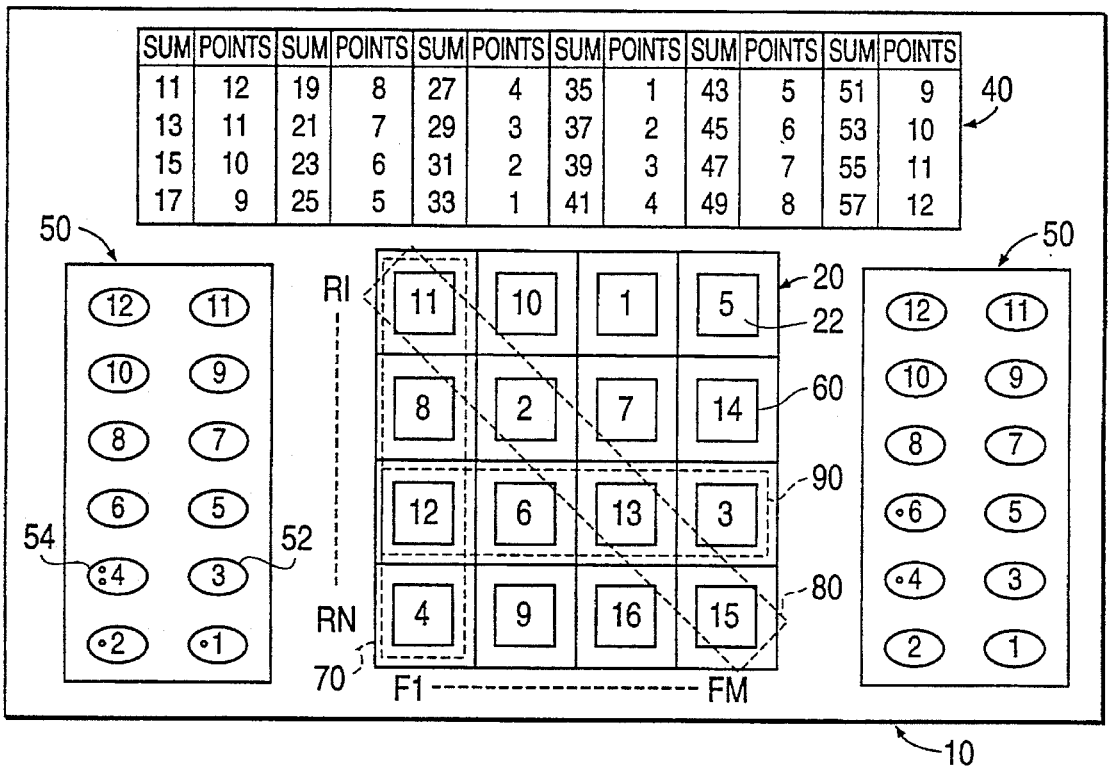
FIG. 1 is a plane view of the preferred embodiment of the board used in the present invention.

The present invention provides a mathematical board game requiring skill rather than "luck-of-the-draw". The game promotes the development of strategic and tactical skills while enhancing mathematical addition skills. Referring to the figures, the preferred embodiment of the present invention will now be described. FIG. 1 illustrates the preferred embodiment of the game board of the present invention. Game board 10 is a flat hard surface made out of a suitable material, such as cardboard, wood, metal, plastic or other desirable material.

Game board 10 may be square or rectangular. Specifically, game board 10 includes a grid 20 defining a plurality of ranks R1, R2, . . . RN and a plurality of files F1, F2, . . . , FM. The ranks and files form corresponding strips which intersect at 90° angles to divide grid 20 into a multiplicity of equal sized squares or spaces 22 which define a plurality of playing positions, each defined by a unique combination of rank and file numbers. Specifically, exemplary space 22 is at rank 1, file 4. Spaces 22 may be defined by solid printed lines formed on the surface of game board 10 or may have a three-dimensional character by including raised wall portions surrounding a space 22 or recessed receiving areas formed into the surface of game board 10 to hold items within the confines of the particular space.

As may be seen from FIG. 1, in the preferred embodiment, the rectangular grid is square and N=M=4. However, from the description below, it will be apparent that a square matrix is not required to play the present game. Further, a larger or smaller grid may be used. From the preferred form of selection of the indicia on the tiles, as described herein below, it will be apparent that the selection of N and M equal to integers greater than 3 is strongly preferred so that there will be enough playing positions to make the game challenging.

The game board 10 preferably also includes a scoring distribution table 40 (sum/point tabulation table) as an integral component of the game board, although not necessary for accomplishing the objects of the present invention. Scoring distribution table 40 provides each player with the point score achievable by certain completed objectives discussed below. The significance of the scoring distribution table is also further described herein below.

Figure 3:
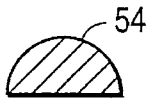
FIG. 3 is a pictorial view of an exemplary scoring stone of the present invention.

The game board further preferably includes a pair of scoring zones 50 also provided as an integral part of game board 10. Scoring zones 50 include a plurality of bins 52 which are preferably recessed areas capable of holding scoring stones 54. Bins 52 may include a numerical indicia representative of a particular point score capable of achievement during play of the game. Scoring stones 54 are provided to permit a player to accurately maintain his or her score during game play. An exemplary scoring stone 54 is shown from in FIG. 3.

Figure 2:
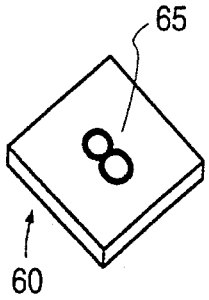
FIG. 2 is a pictorial view of an exemplary playing tile of the present invention.

Turning next to FIG. 2, an exemplary tile 60 is shown. Tiles 60 of the present invention may be made of any suitable substance, preferably wood, plastic, or stiff leather. Tiles 60 are sized to fit within the dimensional confines of playing spaces 20. Indicia may be provided on the upper surface of tile 60 which will be visible to players. The indicia is preferably an integer and can be applied either by placement of another substance on the surface of the tile, such as paint, or by embossing, engraving or the like. It should be understood that the preferred embodiment of the present invention provides N×M=16 such tiles, each of which bears a symbol representing a single positive integer in the range [1, 2, 3, . . . , 16]. On tile 60 illustrated in FIG. 3, the indicium "8" is provided on the surface thereof.

The game is played in the following manner. The objective of the game is for one player to score more points than the opponent by combining his numbered tiles with the opponent's such that the numbers sum to an odd number. Alternatively, the objective of the game may be obtaining an even number sum, or contiguous combinations of numbered tiles which sum to an even number for one player and an odd number for the opponent.

In the preferred embodiment discussed in detail below, each possible odd sum corresponds to a unique score(point) whose value can be obtained by referring to the scoring distribution table 40 or memory. The game is played by two players, preferably, wherein one player plays only the odd-numbered tiles and the other player plays only the even-numbered tiles.

The players first decide who will play the odd-numbered tiles and who will play the even-numbered tiles. This can be achieved by flipping a coin, the blind selection of a tile from a bag, or some other mutually agreed upon method. After the determination of which player is odd and which is even, the odd player plays first. It is important to note that an odd number of odd numbers sum to an odd number, and no other combination of odd or even numbers yield an odd number. This is important in order to establish a logical strategy, and engage in logical scoring tactics.

Each player may place a tile at any position on the board in alternating order. The tiles may be played in any order chosen by the particular player. Preferably, however, the tiles are played in numerically sequential order. Thus, the tile imprinted with a symbol representing the numeral 1 is played first, then the tile imprinted with numeral 2 is played second (by the first player's opponent), then the tile imprinted with numeral 3 is played third, etc. It is clear, then, that it is easy to determine the order of tile placements and which player placed which tiles on the board.

As used in this specification, the concept of a contiguous combination of tiles means that the combination of tiles is located in either rank, file, or diagonally contiguous playing positions. Thus, as shown in FIG. 1, the combination indicated within dashed line 70 is rank contiguous and the combination shown within dashed line 80 is diagonally contiguous. Particularly, combination 70 shows an example of a combination whose sum is 35. By referring to the scoring distribution table 40, the even player would be awarded 1 point after playing tile number 12. The even player would then place a single scoring stone in his number 1 scoring bin. Similarly, a score of 4 points would be awarded to the odd player for combination 80 after playing tile number 15. The odd player would then place a single stone in his number 4 scoring bin. Note, in the preferred embodiment, no points are awarded for forming combinations which sum to an even number. Thus, combination 90 yields no points.

Upon any player preparing to take his turn, the turn can be used to place a tile to block a scoring threat being made by the opponent. This is achieved by placing a fourth tile in the row, column, or diagonal such that the sum is an even number; hence, no one scores, thus blocking the opponents scoring threat. These and other tactical decisions which challenge the players will become apparent from playing the game described herein.

In the preferred form of the game, one player is provided with all odd numbered files in the set [1, 2, 3, . . . , N×M], and the opponent is provided with all even numbered tiles in this set. N is the number of ranks and M is the number of files on the game board. Subsequently, each of the players takes turns placing a single tile on the game board 20. The game is played until all tiles have been played. From the foregoing description, it will be appreciated that the method and apparatus of the present invention provide a mathematical board game wherein strategy and tactics combine to provide contiguous combinations of the tiles along a rank, file, or diagonal whose sum is a member of a predetermined class of numbers, the class of odd numbers in the preferred embodiment.

It is apparent from the scoring distribution table 40 of FIG. 1 that the point value associated with a sum is generally not the same as the point value of other sums, namely, certain sums are worth more points than other sums. Distribution table 40 of FIG. 1 is representative of basic number theory, in particular, the theory of partitions, to the process of forming odd sums with exactly four distinct integers from the set S=[1, 2, 3, . . . , 16]. There is no repetition of integers. A partition theory mathematical formula, which will be described herein, gives precisely the number of ways there are of forming all odd sums using exactly four distinct integers from set S, such sums are called partitions.

Distribution table 40 indicates that, for certain sums, there are many ways to form the sum using 4 distinct integers from set S. For other sums, there are relatively few ways to form the sum. Sums which have many partitions are worth fewer points than those sums which have relatively fewer partitions. Sums which can be formed with many partitions are much easier to form than sums having relatively few partitions, thus, the latter are assigned more points than the former. This is reflected in the scoring distribution table 40.

Applying a partition theory formula to sums formed with exactly four distinct elements from set S yields the following table which lists for each sum the number of ways of forming the sum (without regard to the order of the numbers) from exactly four distinct elements from set S:

TABLE 1

| SUM | # OF PARTITIONS |
|---|---|
| 11 | 1 |
| 13 | 3 |
| 15 | 6 |
| 17 | 11 |
| 19 | 18 |
| 21 | 27 |
| 23 | 38 |
| 25 | 50 |
| 27 | 61 |
| 29 | 71 |
| 31 | 79 |
| 33 | 83 |
| 35 | 83 |
| 37 | 79 |
| 39 | 71 |
| 41 | 61 |
| 43 | 50 |
| 45 | 38 |
| 47 | 27 |
| 49 | 18 |
| 51 | 11 |
| 53 | 6 |
| 55 | 3 |
| 57 | 1 |

Since the preferred embodiment of the present invention involves only odd sums, the first column of the above table lists only odd sums formed with exactly four—the number of tiles in a full rank, file or diagonal in the preferred embodiment of the present invention—distinct elements from set S. The second column denotes the number of ways of forming the sum. Thus, there is only one way to form the sum 11 (without regard to the order of the numbers) using exactly four distinct elements from S=[1, 2, 3, . . . , 16], namely 1+2+3+5. Likewise, there are six ways to form the sum 15, namely 1+2+3+9, 1+2+4+8, 1+2+5+7, 1+4+3+7, 2+3+4+6, and 1+3+5+6. Note that there are 83 ways to form the sums 33 and 35.

There are 24 sums which can be formed using the rules of the present invention. Adding the entries in column two of the above table yields 896 ways to form these 24 sums. Note, also, that the number of partitions is symmetric about the sums 33 and 35, hence only 12 distinct points are required to assign point values to all 24 sums. The inventor has assigned the score point value of 12 to the most difficult sums to form (11 and 57) and a point value of 1 to the easiest sums to form (33 and 35). All other sums are assigned point values within these two extremes. If more tiles are used, and thus a larger number of combinations of integers, the point distribution will likewise be expanded. However, the method of obtaining the resulting point distribution will not change.

By playing the game numerous times, the inventor has determined that this sum/point distribution more than adequately reflects the relative abundance or paucity of combinations. Thus, while the two scoring point extremes (12 and 1) were arbitrarily assigned, the sum/point distribution provides a fair and challenging game which reflects, in point value, the ease or level of difficulty of forming a given sum. Specifically, the formula used to create this table is as follows:

$$\prod_{i=1}^{P} (1 + zx^i) = (1 + zx)(1 + zx^2)(1 + zx^3)(1 + zx^4) \ldots (1 + zx^P)$$

The coefficient of $x^n z^m$ in the resulting polynomial is the number of ways of forming the sum n with exactly m distinct integers between 1 and P. For a more complete understanding of basic number theory, reference is directed to Harriet Griffin's text Elementary Theory of Numbers, (published by McGraw-Hill, International Series in Pure an Applied Mathematics, 1954) pages 193 and 194. This text is hereby incorporated by reference.

Setting P to 16 (the number of ranks times the number of files in the preferred embodiment of the present invention), expanding this product, eliminating even exponents of x and writing only the $$x^n z^4$$

terms yield:

$$1x^{11}z^4 + 3x^{13}z^4 + 6x^{15}z^4 + 11x^{17}z^4 + 18x^{19}z^4 + 27x^{21}z^4 + 38x^{23}z^4 + 50x^{25}z^4 + 61x^{27}z^4 + 71x^{29}z^4 + 79x^{31}z^4 + 83x^{33}z^4 + 83x^{35}z^4 + 79x^{37}z^4 + 71x^{39}z^4 + 61x^{41}z^4 + 50x^{43}z^4 + 38x^{45}z^4 + 27x^{47}z^4 + 18x^{49}z^4 + 11x^{51}z^4 + 6x^{53}z^4 + 3x^{55}z^4 + 1x^{57}z^4$$

Thus, the coefficients of the $$x^n z^4$$

terms in this polynomial yield the number of ways of forming the sum n using exactly 4 distinct integers from [1, 2, 3, . . . , 16].

Of course, if the desired sum is an even number, as provided above, a different set of point values are determined using the above equation for the possible even number combinations. Further, if the first player is attempting to complete odd number combinations and the second player is attempting to complete even number combinations, two sets of point values are obtained and utilized. Thus, the game board on this instance would actually include two (2) scoring distribution tables or one (1) with even and odd scores provided therein.

Developing strategies and tactics to form these sums provides a simple yet entertaining and very challenging game. In view of the foregoing description of the preferred embodiment, other embodiments of the present invention will suggest themselves to those skilled in the art and thus the scope of the present invention is limited only by the claims below.

I claim:

1. A method of playing a mathematical board game by at least two players on a game board having a flat surface for receiving thereon a plurality of tile pieces having numbered indicia thereon, said flat surface including a grid of a plurality of essentially equally sized playing spaces formed by intersecting lines to form a plurality of N ranks and M files, wherein N and M are positive integers, said playing spaces being sized to receive one of said plurality of tile pieces, comprising the steps of:

(a) providing a first player with a first plurality of tile pieces, each of said tile pieces being inscribed with a single, positive, integer b, wherein b is an odd number between and including 1 through N×M;

(b) providing a second player with a second plurality of tile pieces, each of said tile pieces being inscribed with a single, positive, integer c, wherein c is an even number between and including 2 through N×M;

(c) said first player and said second player alternately selecting a tile piece from said first plurality of tile pieces and said second plurality of tile pieces, respectively, and placing the selected tile piece on one of said playing spaces of said grid;

(d) providing a score for each particular one of said first player and second player equal to X, wherein X is equal to a point value assigned to a particular sum of a value of the integers on each tile piece of a rank, file, or diagonally contiguous combination of said tile pieces placed on said grid of said game board by said first and said second players during a plurality of repetitions of step (c), said score provided to said particular one of said first and said second players completing said rank, file, or diagonal of said grid; and (e) repeating steps (c) and (d) above until all tile pieces are played.

2. The method of claim 1, wherein said first and said second players alternately select a tile piece from said first plurality of tile pieces and said second plurality of tile pieces, respectively, in numerically sequential order.

3. The method of claim 1, wherein said score is a function of a number of possible combinations of tile pieces capable of forming a particular sum, a higher score being assigned to sums having a lower number of possible combinations.

4. The method of claim 3, wherein the number of possible combinations of tile pieces capable of forming a particular sum is determined by:

$$\prod_{i=1}^{P} (1 + zx^i) = (1 + zx)(1 + zx^2)(1 + zx^3)(1 + zx^4) \ldots (1 + zx^P)$$

the coefficient of $$x^n z^m$$

in the resulting polynomial is the number of ways of forming the sum n with exactly m distinct integers between 1 and P.

5. The method of claim 3, wherein said sum is an odd number.

6. The method of claim 3, wherein said sum is an even number.

7. The method of claim 3, wherein said sum is an odd or an even number for said first player and the other of said odd or even number for said second player.

8. A method of playing a mathematical board game by at least a first player and a second player comprising the steps of:

(a) providing a game board including indicia thereon defining a rectangular grid of playing positions, a scoring apparatus and a sum/score reference table, said rectangular grid being characterized by N ranks and M files, N and M being positive integers greater than 3, said scoring apparatus consisting of two individual sets of labeled scoring bins, and said sum/score reference table comprising a list of odd sums attainable by a player together with their respective score values;

(b) providing a plurality of scoring stones for placement within said scoring bins;

(c) providing said first player with a plurality of said scoring stones one of which is placed in a labeled scoring bin when the first player scores;

(d) providing said second player with a plurality of said scoring stones one of which is placed in a labeled scoring bin when the second player scores;

(e) providing a first plurality of tile pieces, each of said first plurality being inscribed with a single, positive, odd integer b, b being between and including 1 through N×M;

(f) providing a second plurality of tile pieces, each of said second plurality being inscribed with a single, positive, even integer c, c being between and including 2 through N×M;

(g) providing said first player with said first plurality of tile pieces;

(h) providing said second player with said second plurality of tile pieces;

(i) said first player and said second player alternately selecting one of said tile pieces and placing said tile piece on one of said playing positions of said grid;

(j) providing a score for each particular one of said first player and second player equal to X, wherein X is equal to the point value assigned to the odd sum of a value of the integers on each tile piece of a rank, file, or diagonally contiguous combination of said tile pieces, all placed on said grid of said game board by said first and said second players during a plurality of repetitions of step (i), said score provided to said particular one of said first and said second players completing said rank, file, or diagonal of said grid; and (k) repeating steps (i) and (j) above until all tile pieces are played.

9. The method of claim 8, wherein said first and said second player alternately select a tile piece from said first plurality of tile pieces and said second plurality of tile pieces, respectively, in numerically sequential order.

10. The method of claim 8, wherein said score is a function of a number of possible combinations of tile pieces capable of forming a particular odd sum, a higher score being assigned to odd sums having a lower number of possible combinations.

11. The method of claim 10, wherein the number of possible combinations of tile pieces capable of forming a particular odd sum is determined by:

$$\prod_{i=1}^{P} (1 + zx^{i}) = (1 + zx)(1 + zx^{2})(1 + zx^{3})(1 + zx^{4}) \ldots (1 + zx^{P})$$

the coefficient of $$x^{n}z^{m}$$

in the resulting polynomial is the number of ways of forming the sum n with exactly m distinct integers between 1 and P.

* * * * *